US005328435A

United States Patent [19]

Ricks

[11] Patent Number: 5,328,435

[45] Date of Patent: Jul. 12, 1994

[54] STOMACH MUSCLE BUILDER

[76] Inventor: Jesse L. Ricks, 322 54th St., Newport News, Va. 23607

[21] Appl. No.: 158,428

[22] Filed: Nov. 29, 1993

[51] Int. Cl.[5] ..... A63B 23/00

[52] U.S. Cl. ..... 482/140; 482/145; 482/146; 482/147; 602/24

[58] Field of Search ..... 128/882; 5/648, 651; 602/24; 482/145, 147, 140, 146

[56] References Cited

U.S. PATENT DOCUMENTS

| | | | |
|---|---|---|---|
| 695,538 | 3/1902 | Clairmont . | |
| 1,905,019 | 4/1933 | Turner . | |
| 4,398,713 | 8/1983 | Ellis | 482/145 |
| 4,457,510 | 7/1984 | Pertschuk . | |
| 4,591,148 | 5/1986 | Slater | 482/140 |
| 4,629,180 | 12/1986 | Kaya . | |
| 4,787,626 | 11/1988 | Gallagher . | |

*Primary Examiner*—Richard J. Apley
*Assistant Examiner*—Glenn Richman
*Attorney, Agent, or Firm*—Rhodes & Ascolillo

[57] ABSTRACT

In a preferred embodiment, an apparatus to assist in building stomach muscles by a user performing situps with the apparatus, the apparatus comprising first and second anchoring devices disposed on a horizontal surface, devices to position the first and second anchoring devices spaced apart a selected distance, and attaching devices to releasably attach first and second feet of a user to surfaces of the first and second anchoring devices, respectively, to hold the first and second feet of the user relatively immobile so as to assist the user in performing situps.

11 Claims, 5 Drawing Sheets

STOMACH MUSCLE BUILDER

BACKGROUND OF THE INVENTION

1. Field of the Invention

The present invention relates to exercise equipment generally and, more particularly, but not by way of limitation, to a novel exercise device to assist in strengthening the stomach muscles of a user. 2. Background Art Many people are enthusiastically involved in physical fitness programs, some of which programs simply involve programs of regular walking. At the other end of the spectrum of physical fitness programs are commercial fitness centers which may have very expensive physical training equipment for use by their customers. Many of these fitness centers operate near their capacity to fill the needs of their customers. This situation has led to the popularity of home fitness machines which are convenient to use and which are considerably more accessible than the equipment in commercial fitness centers.

Situps are among the most popular exercises, increasing the mid-body and upper-body strength while burning calories. However, most good exercise machines are prohibitively expensive and, in any case, offer few positions for performing situps.

Some attempts to provide devices to assist in performing situps have been made, as described below:

U.S. Pat. No. 695,538, issued Mar. 18, 1902, to De Clairmont, describes a foldable exercising machine which includes an elongate horizontal bed with a vertical foot board at one end thereof. The footboard includes means to hold the feet of a user thereagainst to assist the user in performing situps. This device permits situps with the user's feet in only one position.

U.S. Pat. No. 1,905,019, issued Apr. 25, 1933, to Turner, describes an exercising apparatus which includes a horizontal base with foot boards rotatably attached to one end thereof, each of the foot boards having an elastic strap attached thereto. A user sits on the base with the user's feet inserted in straps on the foot boards, grasps the distal ends of the elastic straps, and simulates a rowing motion. This device permits some exercising of the stomach muscles, but does not give them the degree of workout achieved with situps.

U.S. Pat. No. 4,457,510, issued Jul. 3, 1984, to Pertshuk, describes an exercising apparatus which includes a panel attached to a vertical wall, the panel having mounted thereon Velcro hook-type patches. A user places on his feet foot-ankle supports having Velcro loop-type patches secured to the soles thereof. The user then lies on the floor near the wall and secures his feet to the panel on the wall by engaging the opposing Velcro patches. The user can now perform "right-angle" situps. This device requires attachment to a wall and permits performing situps only when the user's feet are parallel to the wall surface.

U.S. Pat. No. 4,629,180, issued Dec. 16, 1986, to Kaya, describes an exercise device for performing situps which includes a frame having disposed therein foot restraints, calf restraints, thigh restraints, and a seat, with each of the foregoing elements being adjustable in terms of position and inclination within the frame. This device permits a variety of foot positions, but is relatively complicated, and therefore, relatively expensive.

U.S. Pat. No. 4,787,626, issued Nov. 29, 1988, to Gallagher, describes a situp support device which has a first portion clamped to the lower edge of a door. A second portion of the device is disposed flat on a floor next to the door. A user inserts his feet in straps on the second portion and performs bent knee situps. This device requires attachment to a door and permits performing situps only when the user's feet are parallel to the floor.

Accordingly, it is a principal object of the present invention to provide a stomach muscle builder which is simple and permits performing situps with the user's feet in either vertical or horizontal positions.

It is a further object of the invention to provide such a stomach muscle builder which is self-contained.

It is an additional object of the invention to provide such a stomach muscle builder which is economically and simply constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an apparatus to assist in building stomach muscles by a user performing situps with said apparatus, said apparatus comprising first and second anchoring means disposed on a horizontal surface, means to position said first and second anchoring means spaced apart a selected distance, and attaching means to releasably attach first and second feet of a user to surfaces of said first and second anchoring means, respectively, to hold said first and second feet of said user relatively immobile so as to assist said user in performing situps.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
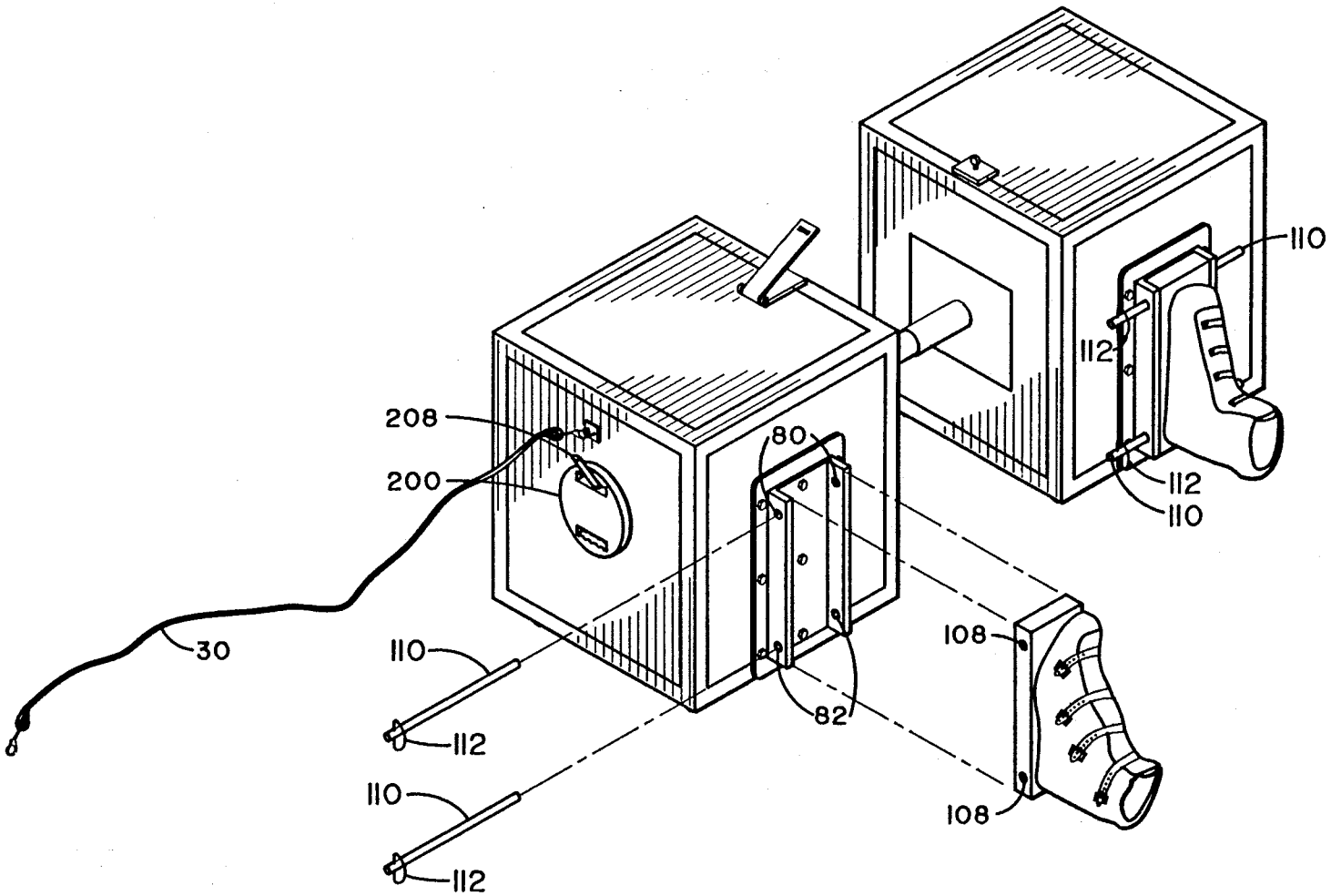
FIG. 1 is a perspective view of a stomach muscle builder, according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
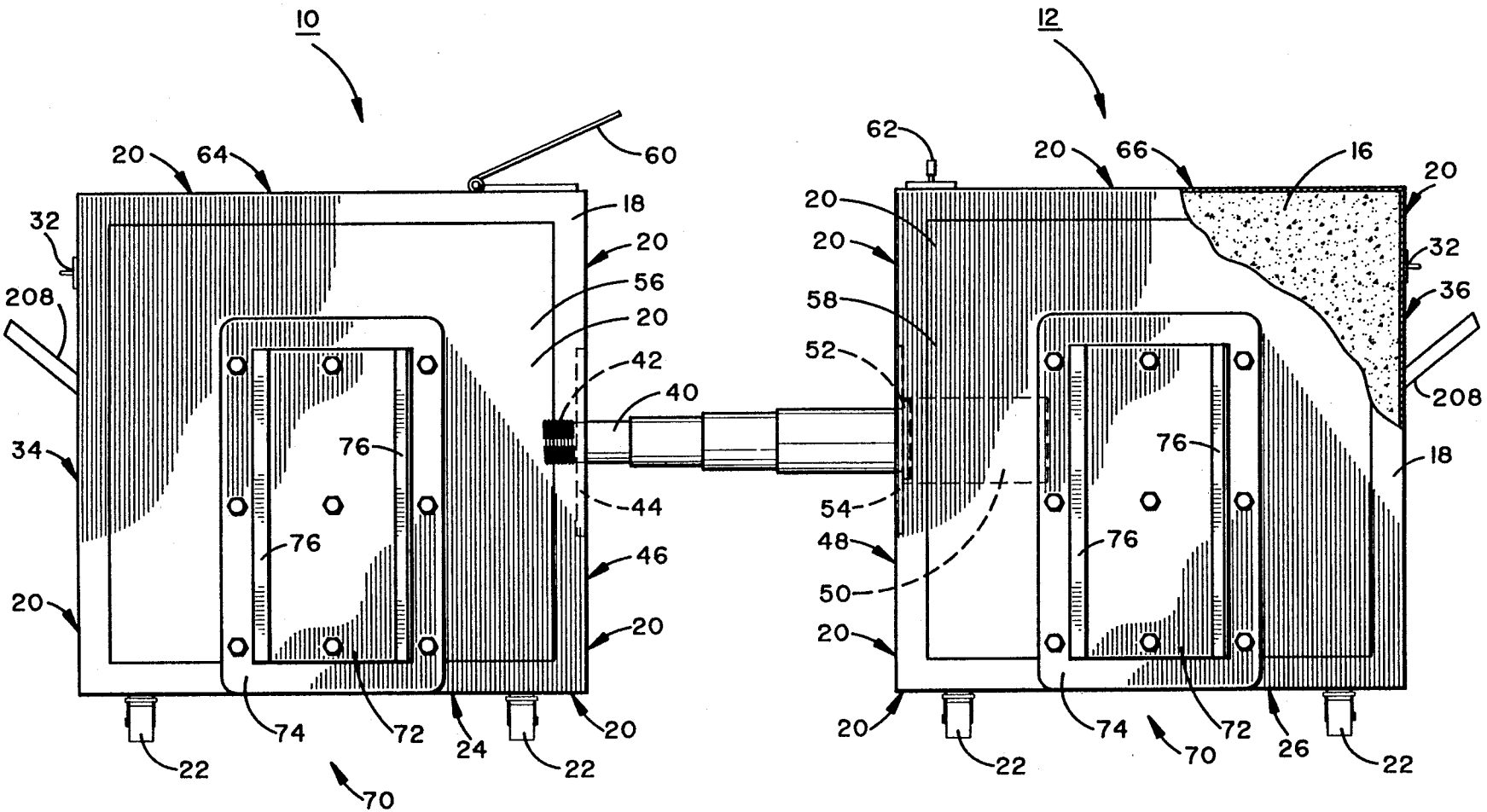
FIG. 2 is a front elevational view, partially cut-away, of a stomach muscle builder, according to the present invention, in an open, operating position, shown without attachable shoes, weight, and strap.
Figure 3:
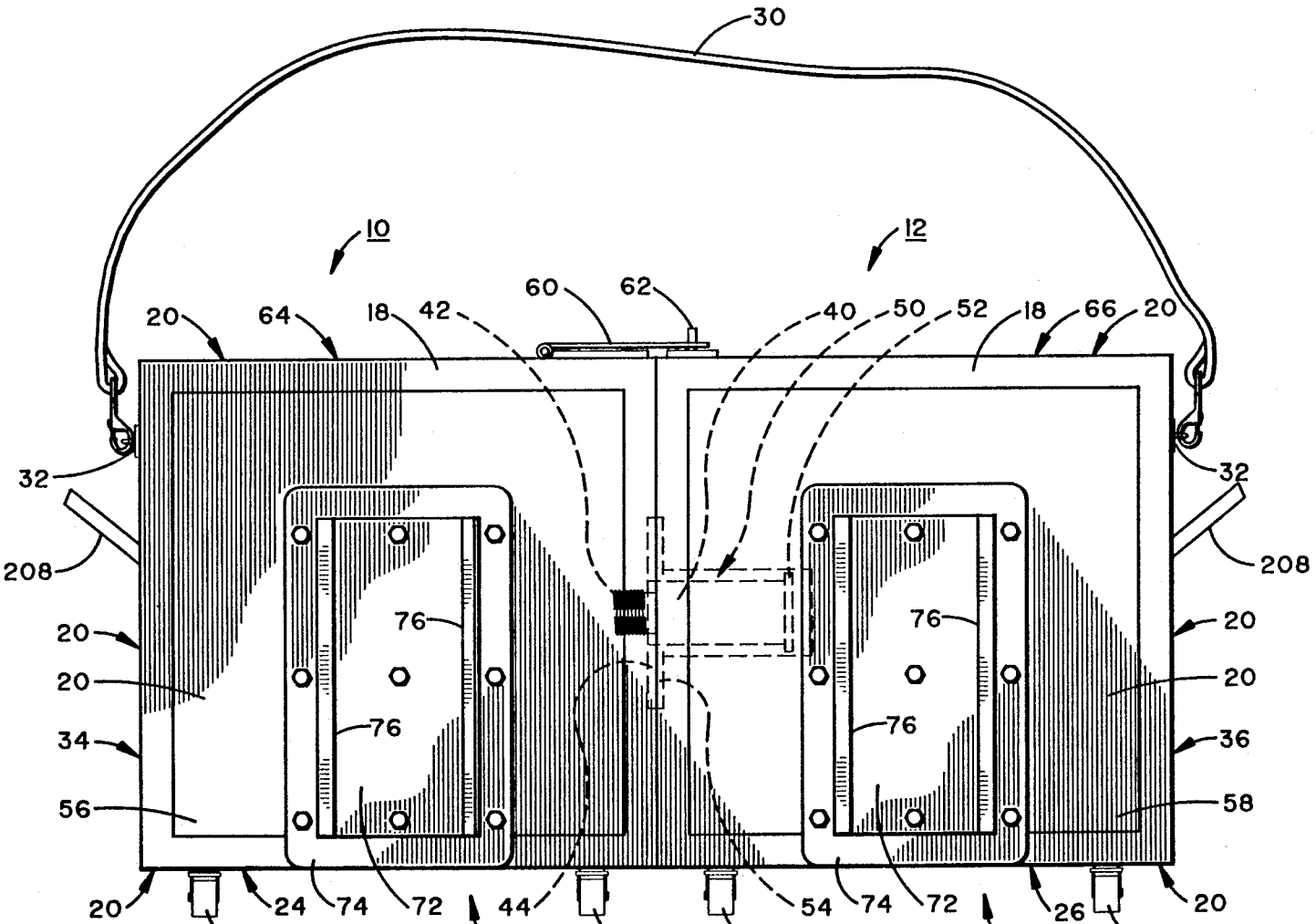
FIG. 3 is a front elevational view of the stomach muscle builder in a closed, storage position, shown without attachable shoes and weight.

FIG. 2 illustrates first and second anchor blocks, generally indicated by the reference numerals 10 and 12, respectively, in an open, operating position, and FIG. 3 illustrates the first and second anchor blocks in a closed, storage position. Each of anchor blocks 10 and 12 comprises a block of concrete 16 (shown in the cutaway portion of FIG. 2) having angle iron 18 disposed fully around all edges thereof to prevent damage thereto. Surface panels 20 are provided on all surfaces of anchor blocks 10 and 12 for protective and cosmetic purposes and may be of any suitable material. Each of anchor blocks 10 and 12 has four locking casters 22 disposed on the bottom surfaces 24 and 26 thereof for convenient positioning of the anchor blocks and to hold the blocks in selected relative position. As is shown on FIG. 3, a flexible strap 30 is clipped to eyepads 32 which are attached near upper edges of anchor blocks 10 and 12, preferably on outer side surfaces 34 and 36 of blocks 10 and 12, respectively. The flexible strap 30 assists in the moving of the anchor blocks 10 and 12.

A horizontal telescoping tubular member 40 extends between adjacent side surfaces 46 and 48 of anchor blocks 10 and 12, respectively. Tubular member 40 is attached to anchor block 10 by means of a first end of the member being threadingly engaged with a internal threaded member 42 disposed in the anchor block, the threaded member held therein by a vertical flange 44 mounted flush with adjacent side surface 46 of the anchor block. Anchor block 12 has a horizontal cylindrical cavity 50 defined therein into which tubular member 40 may be telescopingly folded (FIG. 3). Tubular member 40 is prevented from completely pulling out of cavity 50 by a vertical flange 52 (FIG. 3) formed at a second end of the member, engaging a vertical flange 54 mounted flush with adjacent side surface 48 of anchor block 12. Thus arranged, anchor blocks 10 and 12 may be moved from a closed position (FIG. 3), convenient for storage, to a selectively open position (FIG. 2). Anchor blocks 10 and 12 are secured in their closed position (FIG. 3) by a securing means which includes a hasp 60 mounted to the top surface 64 of anchor block 10 which fits over and engages a vertical pin 62 mounted to top surface 66 of anchor block 12.

Figure 6:
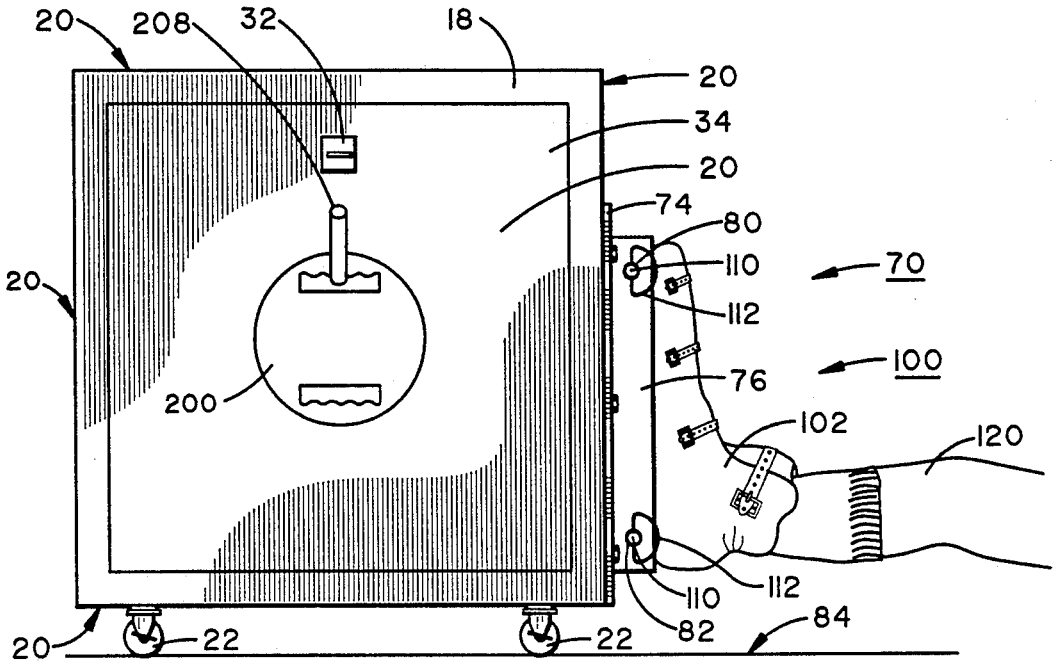
FIG. 6 is a fragmentary side elevational view of the user in a second position.
Figure 5:
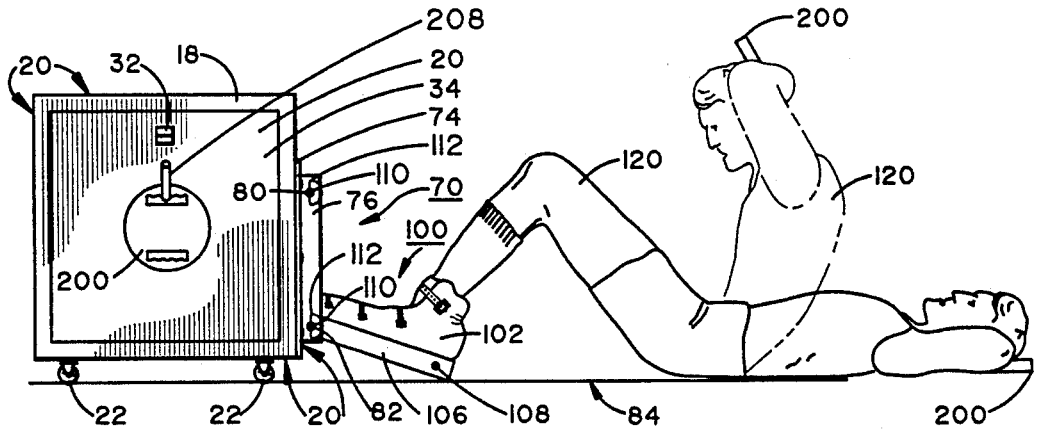
FIG. 5 is a side elevational view of the present invention with a user performing situps in a first position.

Reference should also be made now to FIGS. 5 and 6 together with FIGS. 2 and 3. Each of anchor blocks 10 and 12 has mounted thereto a vertical track assembly, generally indicated by the reference numeral 70. Each of track assemblies 70 includes channel shaped members 72 attached to mounting plates 74 which are securely bolted to front surfaces 56 and 58 of anchor blocks 10 and 12, respectively. Vertical sides 76 of channel shaped members 72 each have defined therethrough (FIGS. 5 and 6) an upper side wall opening 80 and a lower side wall opening 82, the upper side wall openings being disposed at a first elevation and the lower side wall openings being disposed at a second elevation with respect to a horizontal surface 84 upon which anchor blocks 10 and 12 are disposed.

Figure 4:
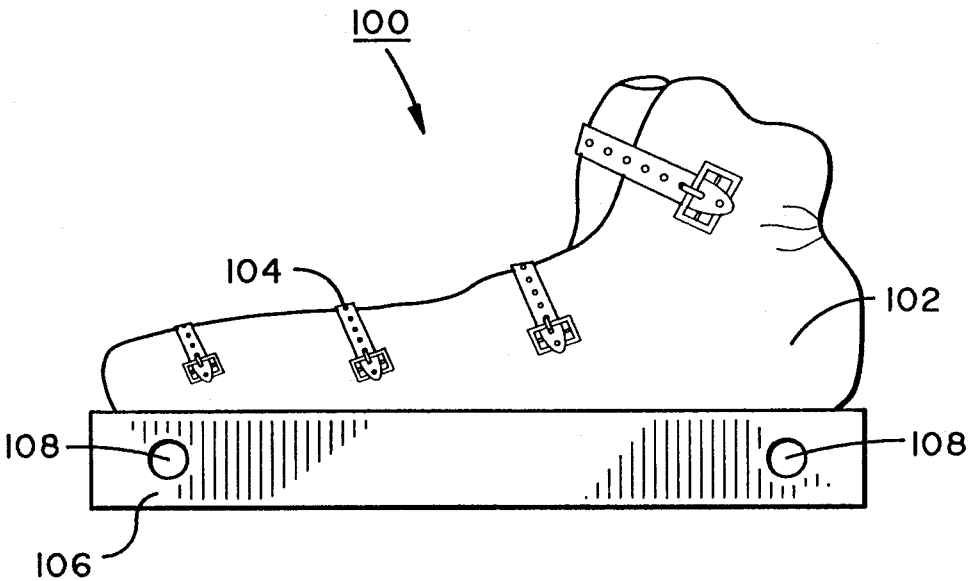
FIG. 4 is a side elevational view of a shoe of the present invention.

Referring now to FIG. 4, there is illustrated a shoe, generally indicated by the reference numeral 100, for use in the present invention. It will be understood that two shoes 100 will be provided. Shoe 100 includes an upper portion 102 having a plurality of straps, as at 104, so that the shoe can be adjusted to accommodate a range of sizes of feet.

Shoe 100 also includes a slide portion 106 to which upper portion 102 is attached. The horizontal width of slide portion 106 is approximately equal to the horizontal width of channel shaped members 72 (FIGS. 2 and 3) of track assemblies 70.

Shoe 100 also has a release mechanism disposed on slide portion 106. The release mechanism includes pin boreholes 108 defined horizontally widthwise through the front and rear portions of slide portion 106, and includes pins 110 which have a ring 112 disposed through a distal end thereof, which can fit into pin boreholes 108 in slide portion 106 of shoe 100. A shoe 100 can be releasably attached to one of anchor blocks 10 or 12 by inserting a shoe 100 into a channel block 72, then by aligning a pin borehole 108 either with upper side wall opening 80 or lower side wall opening 82, and finally by inserting pin 110 through side wall opening 80 or 82 and into pin borehole 108. Ring 112 enables convenient grasping of pin 110 when the pin is being removed from pin borehole 108.

In an alternative embodiment, release snaps are provided near the front and rear of the shoe 100, on either side of slide portion 106, which releasably attach shoe 100 to anchor blocks 10 or 12.

In use, and especially with reference to FIG. 5, anchor blocks 10 and 12 have been moved to a selectively spaced apart relationship (as in FIG. 2) and casters 22 locked. Then a user 120 inserts the front portions of shoes 100 into channel shaped members 72 and engages release snaps 108 (FIG. 4) with lower side wall openings 82. With shoes 100 so anchored in anchor blocks 10 and 12, the feet of user 120 are horizontal, and the user can perform situps as shown in FIG. 5.

Referring now to FIG. 6, it can be seen that shoes 100 have been fully inserted into channel shaped members 72, with pins 110 (FIG. 4) engaged with side wall openings 80 and 82. User 120 can now perform situps with his feet in a substantially vertical position.

In either position, anchor blocks 10 and 12 are substantially immobile.

Figure 7:
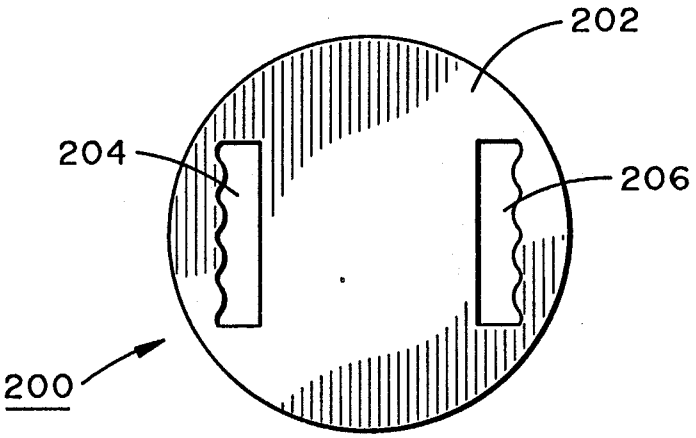
FIG. 7 is a top plan view of a weight useful in performing situps with the present invention.

FIG. 7 illustrates a weight, generally indicated by the reference numeral 200, that is useful in providing additional resistance while performing situps with the present invention. Weight 200 includes a disk 202 of suitable heavy material, the disk having deigned therethrough open hand grips 204 and 206 through which the hands (not shown) of user 120 (FIG. 5) may be inserted. In use, user 120 inserts his fingers and the upper portions of his palms through hand grips 204 and 206 and holds weight 200 behind his neck while performing situps. Hand grips 204 and 206 preferably have a resilient material disposed therearound.

As seen in FIG. 1, user 120 can store weight 200 on a peg 208, shown in FIG. 1 being disposed on outer side surface 34, when the weight 200 is not in use. It should be understood that more than one peg 208 and more than one weight 200 may be provided.

It can be seen that the apparatus of the present invention is self-contained, does not rely on attachment to other structures or fixtures, is simple, and is economically constructed.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An apparatus to assist a user in building stomach muscles by performing situps on a horizontal surface with said apparatus, said apparatus comprising:

(a) first and second anchoring means, each of said anchoring means having a front surface, a top surface, a bottom surface, an adjacent side surface, and an outer side surface disposed opposite said adjacent side surface;

(b) spacing means to position said first and second anchoring means at a selected distance apart; and (c) attaching means disposed on the front surface of each of said anchoring means, said attaching means for releasably attaching first and second feet of the user to the outer working surface of said first and second anchoring means, respectively, to hold said first and second feet of said user relatively immobile, and to hold said first and second feet in a selected foot position which is selected from a first position wherein said first and second feet are disposed in a substantially horizontal plane, and from a second position wherein said first and second feet are disposed in a substantially vertical plane; said attaching means comprising first and second vertical channel shaped members mounted to said front surfaces of said first and second anchoring means, respectively, said vertical channel shaped members having vertical side walls; and first and second shoes having, respectively, first and second upper portion attached to first and second lower slide portions, said slide portions being releasably engageable with said vertical side walls to position said feet in the selected foot position.

2. An apparatus, as defined in claim 1, wherein said apparatus further comprises:

(a) at least two side wall openings disposed through each of said vertical side walls further comprises an eyelet; and (b) a release mechanism disposed upon the slide portion of each of said shoes.

3. An apparatus, as defined in claim 2, wherein said release mechanism comprises:

(a) at least two pin boreholes defined horizontally widthwise through said slide portion of each of said shoes; and (b) at least two pins capable of passing through the side wall openings and into the pin boreholes.

4. An apparatus, as defined in claim 2, wherein said release mechanism comprises a release snap disposed upon said lower slide portion of each of said first and second shoes, said release snap releasably engaging said side wall opening, thereby releasably engaging each of said first and second shoes to said vertical side wall.

5. An apparatus, as defined in claim 1, wherein said first and second anchoring means further comprises first and second concrete blocks, respectively, said concrete blocks having angle iron reinforcement members disposed around edges thereof.

6. An apparatus, as defined in claim 1, wherein said spacing means comprises a telescoping tubular member extending between said adjacent side surfaces.

7. An apparatus, as defined in claim 1, wherein said apparatus further comprises:

(a) an eyepad disposed on the outer side surface of each of said first and second anchoring means;

(b) a flexible strap having first and second ends;

(c) a clip disposed at each of said first and second ends of the flexible strap, the clip being releasably attachable to the eyepad.

8. An apparatus, as defined in claim 7, wherein said apparatus further comprises:

(a) a peg disposed on the outer side surface of said first and second anchoring means; and (b) a weight having two open hand grips defined therethrough, wherein:

said weight to be held by the user behind the user's neck while the user is performing said situps; and said weight to be releasably attached to said peg when the weight is being stored.

9. An apparatus, as defined in claim 1, wherein said apparatus further comprises four locking casters disposed on the bottom surface of each of said first and second anchoring means, said casters capable of being releasably locked to substantially prevent the first and second anchoring means from moving on the horizontal surface upon which the apparatus is disposed.

10. An apparatus, as defined in claim 1, wherein said apparatus further comprises a securing means, said securing means comprising:

(a) a vertical pin fixedly attached to the top surface of the second anchoring means; and (b) a hasp fixedly attached to the top surface of the first anchoring means, said hasp being capable of releasably engaging said vertical pin thereby preventing relative movement between said first and second anchoring means.

11. An apparatus, as defined in claim 1, wherein said first and second anchoring means further comprises protective panels disposed on outer surfaces of each anchoring means.

* * * * *